US005189688A

United States Patent [19]

Ono et al.

[11] Patent Number: 5,189,688

[45] Date of Patent: Feb. 23, 1993

[54] ROTARY-ANODE TYPE X-RAY TUBE

[75] Inventors: Katsuhiro Ono, Utsunomiya; Hidero Anno; Hiroyuki Sugiura, both of Ootawara; Takayuki Kitami, Tochigi; Hiroaki Tazawa, Ootawara, all of Japan

[73] Assignee: Kabushiki Kaisha Toshiba, Kawasaki, Japan

[21] Appl. No.: 766,069

[22] Filed: Sep. 27, 1991

[30] Foreign Application Priority Data

Oct. 5, 1990 [JP] Japan ..... 2-266268

[51] Int. Cl.[5] ..... H01J 35/26

[52] U.S. Cl. ..... 378/133; 378/132

[58] Field of Search ..... 378/132, 133

[56] References Cited

U.S. PATENT DOCUMENTS

| | | | |
|---|---|---|---|
| 3,399,000 | 8/1968 | Remmers . | |
| 4,210,371 | 7/1980 | Gerkema et al. | 378/133 |
| 4,614,445 | 9/1986 | Gerkema et al. | 378/133 |
| 4,641,332 | 2/1987 | Gerkema | 378/133 |

FOREIGN PATENT DOCUMENTS 0141475 5/1985 European Pat. Off. .

OTHER PUBLICATIONS

Philips Technical Review, vol. 27; pp. 107–108; 1966; G. Remmers, Grease-Lubricated Spiral Groove Bearing for a Straight-Through Shaft.

*Primary Examiner*—Craig E. Church

*Attorney, Agent, or Firm*—Cushman, Darby & Cushman

[57] ABSTRACT

A rotary-anode type X-ray tube wherein bubbles produced in the gap of a sliding bearing are securely and easily replaced with liquid metal lubricant, and the metal lubricant is prevented from leaking. The rotary anode is secured to a cylindrical rotary structure. A columnar fixed structure is secured to the rotary structure forming a gap between the rotary structure and fixed structure. A liquid metal lubricant fills the gap. Spiral grooves are formed on a part of the outer surface of the fixed structure and the sliding bearing is installed between the fixed structure and the rotary structure. The rotary structure and fixed structure are housed in a vacuum envelope. The gap of the sliding bearing is connected to the space inside the vacuum envelope through an annular space. A gap is formed between a ring block for blocking the opening of the rotary structure and the fixed structure. A spiral groove to return the metal lubricant to the annular space is formed on the outer surface of the ring block facing the gap, and the annular space is coated with a film repelling the metal lubricant. The annular space and the gap between the ring block and the fixed structure serve to separate from the metal lubricant in the sliding bearing, the bubbles produced therein.

13 Claims, 9 Drawing Sheets

ROTARY-ANODE TYPE X-RAY TUBE

BACKGROUND OF THE INVENTION

1. Field of the Invention

The present invention relates to a rotary-anode type X-ray tube and, more particularly, to an improvement in the structure of a bearing for supporting a rotary-anode of the X-ray tube.

2. Description of the Related Art

As is know, in a rotary-anode type X-ray tube, a disk-like anode target is supported by a rotary structure and a stationary shaft which have a bearing portion therebetween, and an electron beam emitted from a cathode is applied to the anode target while the anode target is being rotated at high speed by energizing an electromagnetic coil arranged outside a vacuum envelope, thereby the target irradiates X-rays. The bearing portion is constituted by a rolling bearing, such as a ball bearing, or a hydro-dynamic pressure type sliding bearing which has bearing surfaces with spiral grooves and uses a metal lubricant consisting of, e.g., gallium (Ga) or a gallium—indium—tin (Ga—In—Sn) alloy, which is liquid state during an operation. Rotary-anode type X-ray tubes using the latter bearing are disclosed in, e.g., Published Examined Japanese Patent Application No. 60-21463 and Published Unexamined Japanese Patent Application Nos. 60-97536, 60-117531, 62-287555, 2-227947, and 2-227948.

In the rotary-anode type X-ray tubes disclosed in the Publication or Disclosures, the gap between bearing surfaces of a hydro-dynamic pressure type sliding bearing is kept at, for example, 20 μm and filled with liquid metal lubricant. If air is removed from the gap while the X-ray tube is being assembled, or gas is produced in the lubricant when the X-ray tube is energized, the gap is locally free from liquid metal lubricant due to the bubbles of air or gas. Otherwise, the lubricant may leak from the bearing, together with the bubbles. Accordingly, if the air or gas is removed from or introduced into the sliding bearing, the bearing cannot stably operate for a long period of time. If the lubricant leaks from the bearing into the vacuum envelope of the tube, the high voltage characteristic of the X-ray tube may be degraded.

SUMMARY OF THE INVENTION

It is an object of the present invention to provide a rotary-anode type X-ray tube for securely and easily replacing bubbles, formed in a bearing, between a rotary structure and fixed structure, with liquid metal lubricant, thereby preventing the lubricant from leaking in the space in a vacuum envelope, and thus enabling the bearing to operate stably.

According to the present invention, there is provides a rotary-anode type X-ray tube comprising:

A rotary-anode type X-ray tube comprising an anode target, a rotary structure to which the anode target is fixed, a stationary structure, coaxially arranged with the rotary structure, for rotatably holding the rotary structure, a hydrodynamic bearing formed between the rotary structure and the stationary structure, having a first gap in which a metal lubricant is applied, the lubricant being in liquid state during rotation of the rotary structure, a vacuum envelope in which the rotary and stationary structures and the hydrodynamic bearing are installed, and means for preventing lubricant from leaking, which includes an annular space which is formed between the rotary structure and fixed structure and communicating with the first gap and a second gap which is formed between the rotary structure and fixed structure, the second gap communicating with the annular space and the inner space of the vacuum envelope, and being narrower than the annular space.

Even if bubbles (or gas) are produced in the hydrodynamic bearing while the rotary-anode type X-ray tube is being assembled, or while the X-ray tube is operating, these bubbles move into the annular space through the first gap provided within the bearing. The bubbles need to expel the metal lubricant into the annular space. The gas pressure abruptly decreases, however, when the bubbles reach the annular space which is relatively large. Consequently, the gas cannot expel the metal lubricant from the annular space into the vacuum envelope through the second gap which is narrow and formed in the lubricant-leak preventing means. The gas is gradually discharged into the vacuum envelope. As a result, the metal lubricant flows back into the first gap, thus lubricating the hydrodynamic bearing.

Hence, even if gas is generated in the bearing, it is smoothly replaced by the metal lubricant in the annular space, and the lubricant is prevented from leaking into the vacuum envelope. The first gap formed in the bearing is thereby filled with a desired amount of the metal lubricant, enabling the hydrodynamic bearing to operate stably for a long period of time.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

There will be described a rotary-anode type X-ray tube according to the embodiments of the present invention with reference to the drawings.

Figure 1:
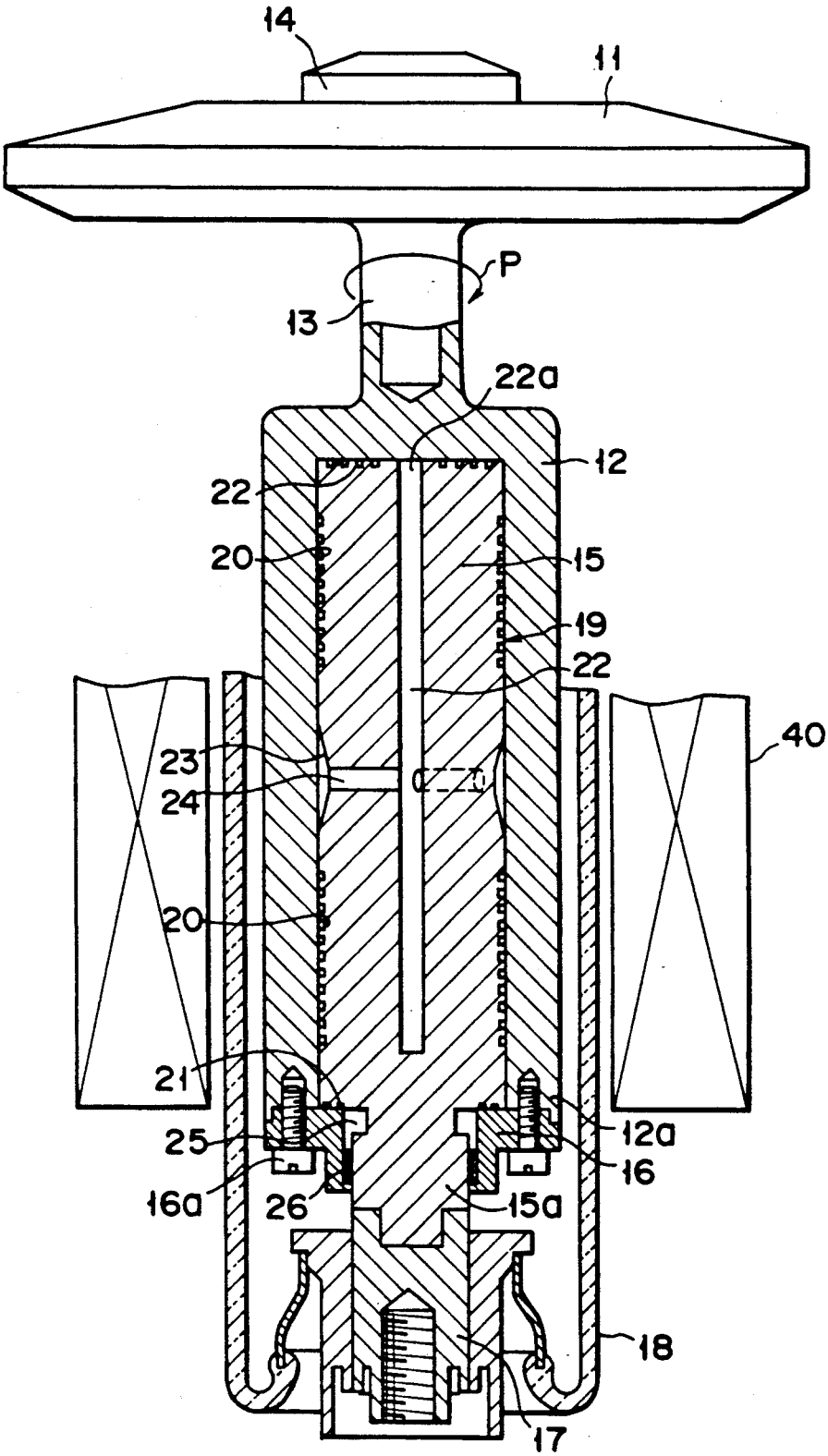
FIG. 1 shows a longitudinal sectional view of the rotary-anode type X-ray tube according to an embodiment of the present invention.
Figure 2:
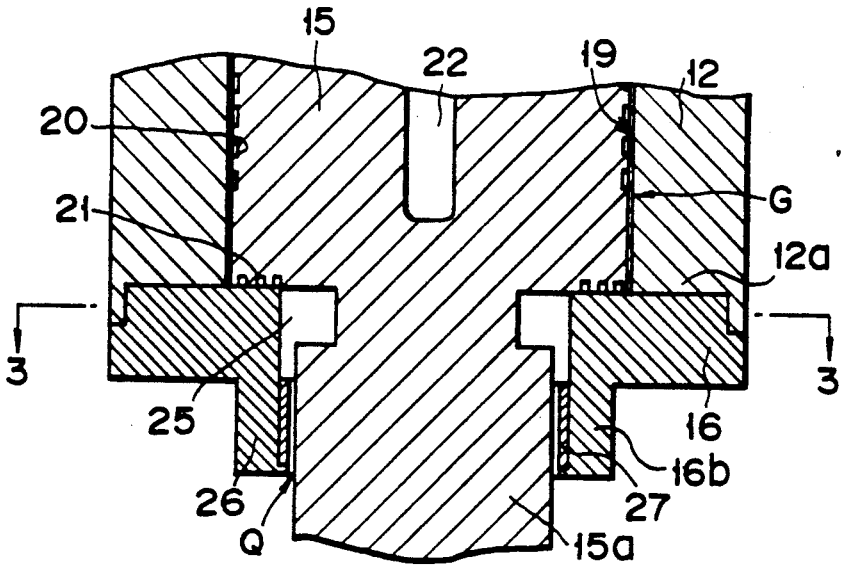
FIG. 2 shows an enlarged sectional view of a part of the rotary-anode type X-ray tube shown in FIG. 1.
Figure 3:
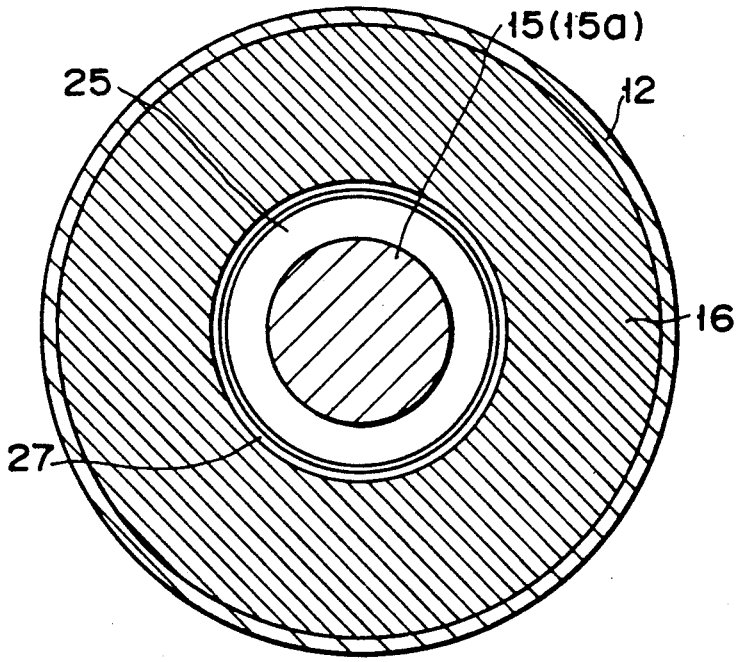
FIG. 3 shows a transverse sectional view along the line 3—3 in FIG. 2.

A rotary-anode type X-ray tube of the invention is shown in FIGS. 1 to 3. A disk-like anode target 11 made of heavy metal is secured to the rotary shaft 13 by a screw 14 and the rotary shaft 13 is fixed to one end of a cylindrical rotary structure 12. A cylindrical stationary shaft 15 can be inserted in the rotary structure 12 through the opening section 12*a* of the rotary body 12 and fits in the rotary structure 12. The stationary shaft 15 has a small-diameter portion 15*a* which is closely arranged at the opening section 12*a* of the rotary structure 12. A ring block 16 is secured to the opening section 12*a* of the rotary body 12 by a plurality of screws 16*a*, and encloses the small-diameter portion 15*a* of the stationary shaft 15 and substantially closes the opening 12*a* of the rotary structure 12. The iron support base 17 is brazed to the small-diameter portion 15*a* of the fixed shaft 15 so that the rotary structure 12 and stationary shaft are supported on the support base 17. A glass vacuum envelope 18 is vacuum-tightly coupled to the support base 17.

Between the rotary structure 12 and the stationary shaft 15, a hydrodynamic pressure type bearings 19 disclosed in the above mentioned Publication or Disclosures are formed. That is, spiral grooves 20 and 21 of a herringbone pattern are formed on the outer peripheral surface and at the both end faces of the stationary shaft 15, constituting radial and thrust bearings. The inner surface of the rotary body 12 facing the grooves is formed as a flat bearing surface. A spiral groove may be also formed on the inner surface of the rotary structure 12 as a bearing surface. Each of the bearings between the rotary structure 12 and stationary shaft 15 has a gap G of approx. 20 μm.

The stationary shaft 15 has a hollow space as a lubricant storing chamber 22 formed along its center axis. The opening 22*a* of the lubricant storing chamber 22 communicates with the gap G of the thrust bearing between the inner face of the rotary body 12 and the end face of the shaft 15. The gap G communicates with the gap G of the radial bearing between the outer periphery of the stationary shaft 15 and the inner surface of the rotary body 12. The middle portion of the stationary shaft 15 is slightly tapered, forming a small-diameter portion 23. Three paths 24 which are opened on the small-diameter portion 23 and communicated with the lubricant storage chamber 22 are radially formed in the shaft 15 at the interval of 120° around the axis of the shaft and we arranged symmetrically to the axis of the shaft.

An annular groove 25 is formed by circumferentially cutting a part of the small-diameter portion 15*a* of the stationary shaft 15 so that a circumferential cavity 25 is formed between the ring block 16 and the small-diameter portion 15*a* of the stationary shaft 15 as shown in FIGS. 1 and 2. The annular groove 25 has a width much larger than the gap G of the bearing along the radius direction, and is arranged, as an interface between the bearing, between the rotary structure 12 and stationary body 15 and the inner space in the vacuum envelope 18.

The ring block 16 has an integral hollow cylinder 16*b* which surrounds the small-diameter portion 15*a* of the stationary shaft 15. A ring 27 is attached to the hollow cylinder 16*b* and located between the vacuum envelope 18 and the annular groove 25. The ring 27 is placed in contact with the inner surface of the cylinder 16*b*. The ring 27 is made of material which can hardly be wetted with the metal lubricant, or rather repels the metal lubricant. This material is, for example, ceramics, such as alumina ($Al_2O_3$), boron nitride (BN), or silicon nitride ($Si_3N_4$). A gap is provided between the small-diameter portion 15*a* and the ring 27. The gap is 100 micrometers or less wide, as measured in the radial direction of the ring block 16.

Figure 4:
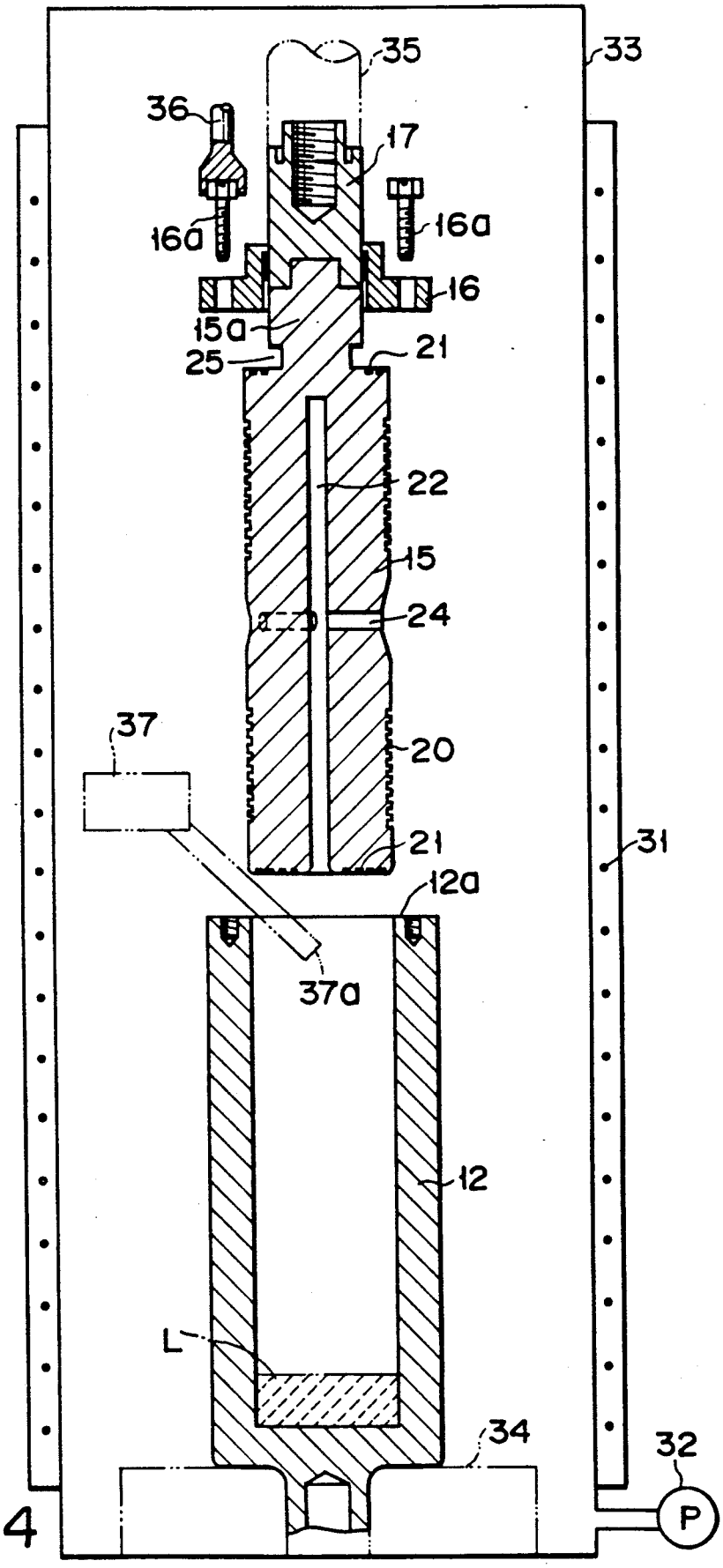
FIG. 4 shows a longitudinal sectional view of some components of the rotary-anode type X-ray tube in FIG. 1, which is being assembled.

The rotary-anode structure is assembled by mounting the rotary structure 12 with its opening section 12*a* turned upward on the supporting base 34 as is shown by a one-dot chain line as shown in FIG. 4. It is installed in the vacuum bell jar 33 having a heater 31, which is evacuated by an exhaust pump 32. A stationary shaft holder 35 is installed in the vacuum bell jar 33, and suspends the shaft 15. The stationary shaft 15 is located above the rotary structure 12. The ring block 16 is held by a holder (not illustrated) on the upper outer periphery of the stationary shaft 15. Screws 16*a* securing it are held at the specified position by a fastening tool 36. Moreover, a lubricant injector 37 storing metal lubricant, such as Ga alloy, is installed. A controller (not illustrated) outside the bell jar moves the injection port into the opening of the rotary structure 12, so that the lubricant can be applied into the rotary structure 12 as is illustrated. Firstly, components and devices are arranged as is shown in FIG. 4, and the bell jar is evacuated to a high vacuum of, for example, approx. $10^{-5}$ Pa. Secondly, the temperature of each bearing member is raised to 300° C. or higher (e.g. approx. 400° C.) by the heater 31 and kept at that temperature for a certain time. Thus, the stored gas is discharged from each component and also from the liquid metal lubricant. Thirdly, the controller moves the lubricant injector 37 into the hollow space of the rotary structure 12, as is shown in FIG. 4. The specified amount of liquid metal lubricant L is thereby injected into the rotary structure 12. Fourthly, the controller outside the bell jar is driven to move the lubricant injector 37 to a home position and slowly lower the stationary shaft 15 from the top to insert it into the rotary structure 12. Thus, the liquid metal lubricant L flows from the bottom of the rotary structure 12 into the lubricant storing chamber 22 of the rotary structure 15 and also into the gaps of the bearings.

In this case, if gas is discharged from the members, and bubbles are produced in the lubricant, the bubbles move upward, passing through the gap of the bearing and are hence exhausted. Then, the lubricant flows into the members. The lubricant overflows into the circumferential hollow 25, though in a very small amount.

Figure 5:
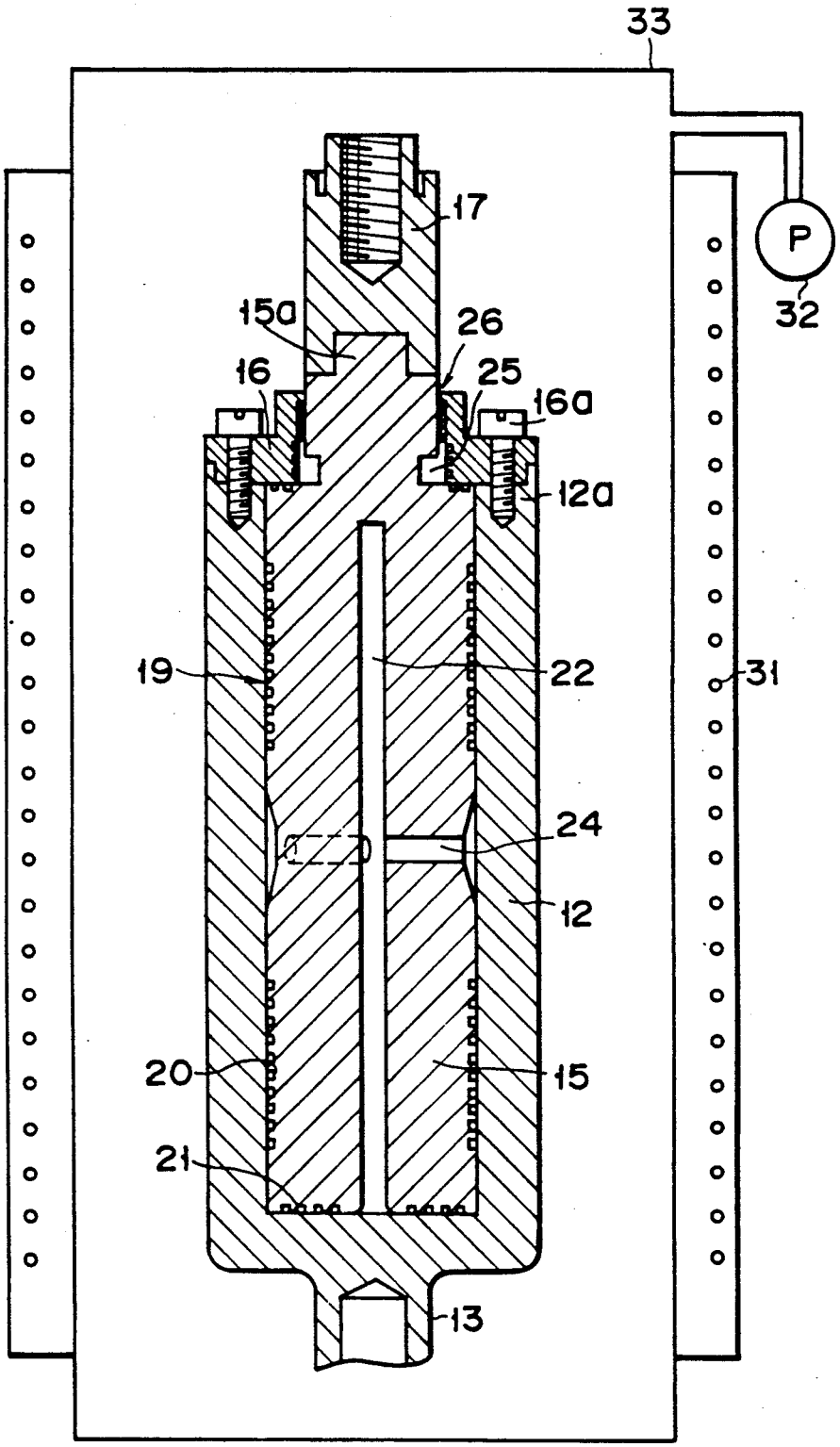
FIG. 5 shows a longitudinal sectional view of the structural body made of the components shown in FIG. 4.

Thus, the gas is replaced by the lubricant. Then, as shown in FIG. 5, the ring block 16 fits into the rotary body opening 12*a* and secured by fastening screws 16*a* with a fastening tool 36. The resultant structure is slowly cooled in vacuum. Thus, a rotary-anode structure is made, which has a bearing surface gap G, a lubricant path communicating with the gap, and a lubricant storing chamber, filled with liquid metal lubricant. The rotary-anode structure is installed in the glass vacuum envelope 18. The container 18 is evacuated, whereby an X-ray tube is manufactured.

The rotary-anode type X-ray tube is operated as follows. A stator or electromagnetic coil 40 is located outside the vacuum envelope 18 and around the rotary body 12. The coil 40 generates a rotating magnetic field, thereby rotating the rotary anode at a high speed in the direction of the arrow P. As liquid metal lubricant fills the sliding bearing is such a manner the adequately, smooth dynamic-pressure bearing operation is thereby performed. The liquid metal lubricant flows to the bearing from a central lubricant-storing chamber 22 through path 24 to realize stable dynamic-pressure bearing operation. This is because the pressure at the bearing surface is low. The bearing surface is thereby wetted well with the lubricant. Even if the lubricant oozes to the rotary body opening side during the operation, it stays in the large-capacity annular space 25 and returns to the bearing surface either directly or through each lubricant path. The electron beam emitted from a cathode (not shown) is applied to the anode target. The anode target generates X-rays and heat. The heat is dispersed outside, in the form of radiation, or conduction passing through the rotary body, the liquid metal lubricant in the bearing, and the stationary shaft 15.

Figure 6:
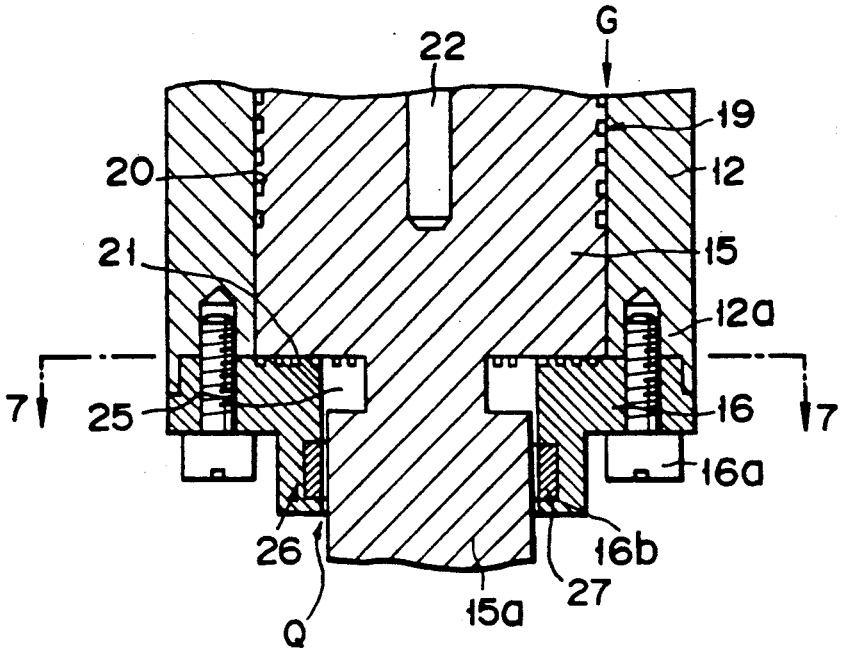
FIG. 6 shows a longitudinal sectional view of the essential portion of the rotary-anode type X-ray tube according to a modified embodiment of the present invention.
Figure 7:
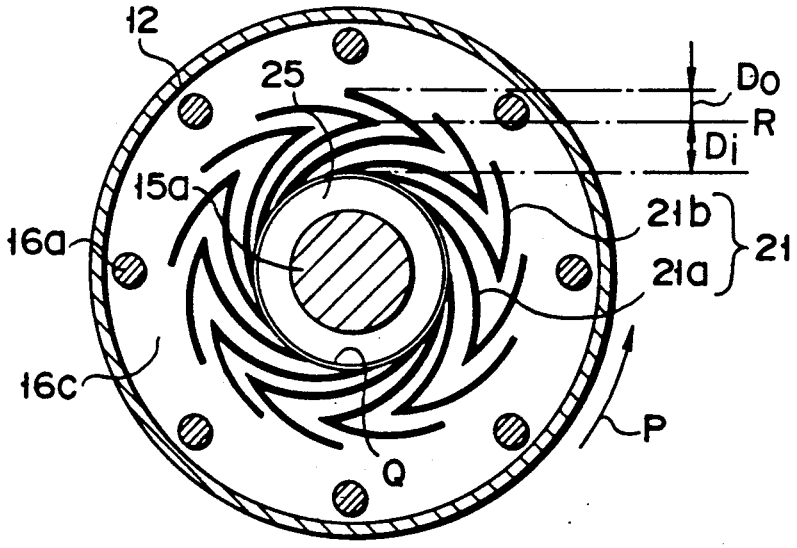
FIG. 7 is a cross sectional view along a 7—7 line shown in FIG. 6.

FIGS. 6 and 7 show a modified embodiment of the invention, wherein helical grooves of herring bone pattern 21 are formed in the thrust-bearing surface 16*c* of the ring block 16. Each helical groove 21 is L-shaped, consisting of an inner part 21*a* and an outer part 21*b* connected at one end R of the inner part 21*a*. The parts 21*a* and 21*b* are gently curved. The radial distance Di between the ends of the inner part 21*a* is longer than the radial distance Do of the outer part 21*b*. The bearing surface of the stationary shaft 15 defines part of the annular groove 25. The inner part 21*a* of each helical groove 21 communicates with the annular groove 25. While the rotary structure 12 is rotating, the force generated in the inner part 21*a* of each groove 21 attracting the lubricant is greater than the force created in the outer part 21*b* attracting the lubricant. Hence, the lubricant, if accumulating in the annular groove 25, can flow back toward the hydrodynamic bering 19.

The radial distance Di between the ends of the inner part 21*a* can be equal to the radial distance Do of the outer part 21*b*, and the inner part 21*a* can be deeper than the outer part 21*b*. In this instance, too, the lubricant, if accumulating in the annular groove 25, can flow back toward the hydrodynamic baring 19 while the rotary structure 12 is rotating.

Alternatively, the radial distance Di between the ends of the inner part 21*a* can be longer than the radial distance Do of the outer part 21*b*, and the inner part 21*a* can be deeper than the outer part 21*b*. In this case, the lubricant, if accumulating in the annular groove 25, can more readily flow back toward the hydrodynamic bearing 19 while the rotary structure 12 is rotating.

Figure 8:
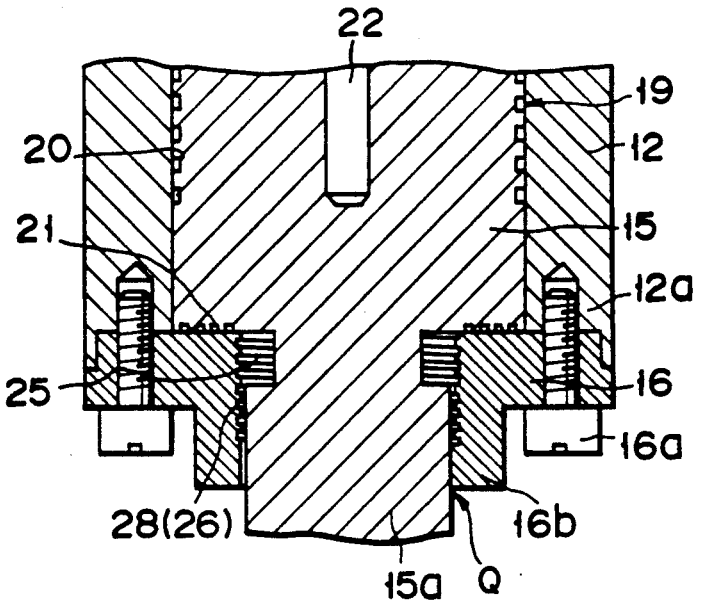
FIG. 8 shows a longitudinal sectional view of the essential portion of the rotary-anode type X-ray tube according to an another embodiment of the present invention.

In the embodiment shown in FIG. 8, a pumping spiral groove 28 or a lubricant leak preventive member 26, is formed in the inner wall of the ring block 16 for closing the opening. More precisely, the groove 28 extends to the middle portion of a cylinder 16*b* from the cylindrical hollow space 25. The liquid metal lubricant is prevented from leaking into the space in the vacuum envelope 18, due to the pumping action of the rotating cylinder 16*b* on which the groove 28 is formed.

Figure 9:
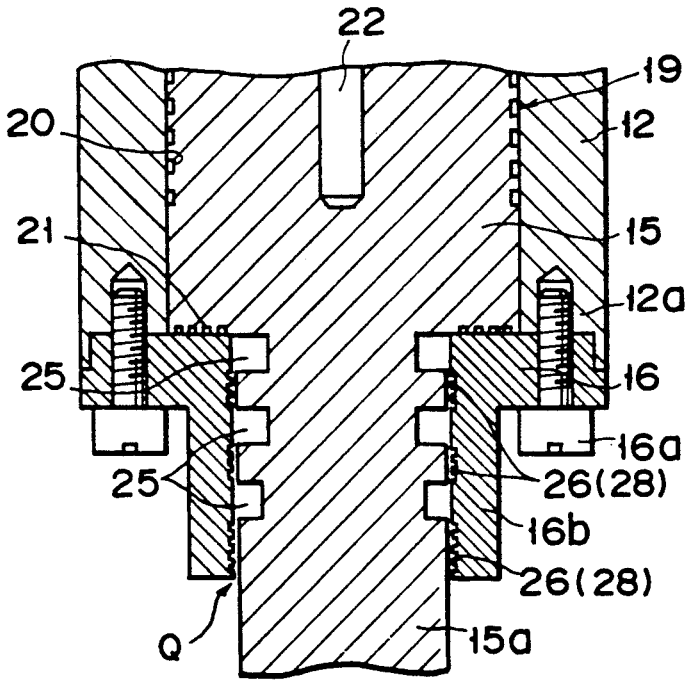
FIG. 9 shows a longitudinal sectional view of the essential portion of the rotary-anode type X-ray tube according to still another embodiment of the present invention.

In the embodiment shown in FIG. 9, three circumferential hollow space 25 are formed in tandem on the small-diameter portion 15*a* of the stationary shaft 15. Therefore, the inner periphery of the cylinder 16*b* faces the small-diameter portion 15*a* of the shaft 15, across the hollow spaces 25 and a small gap. The small gap is specified much less than the width of each hollow space. The pumping spiral groove 28 is formed in the inner periphery of the cylinder 16*b*, in the small gap, in order to prevent the lubricant from leaking.

In the above structure, bubbles, if produced in the bearing, are smoothly replaced by liquid metal lubricant. Moreover, if the lubricant oozes out of the bearing, it stays in a plurality of hollows, and leak of the lubricant into the vacuum container 18 is prevented by the pumping action of the pumping spiral groove 28 in each gap.

Figure 10:
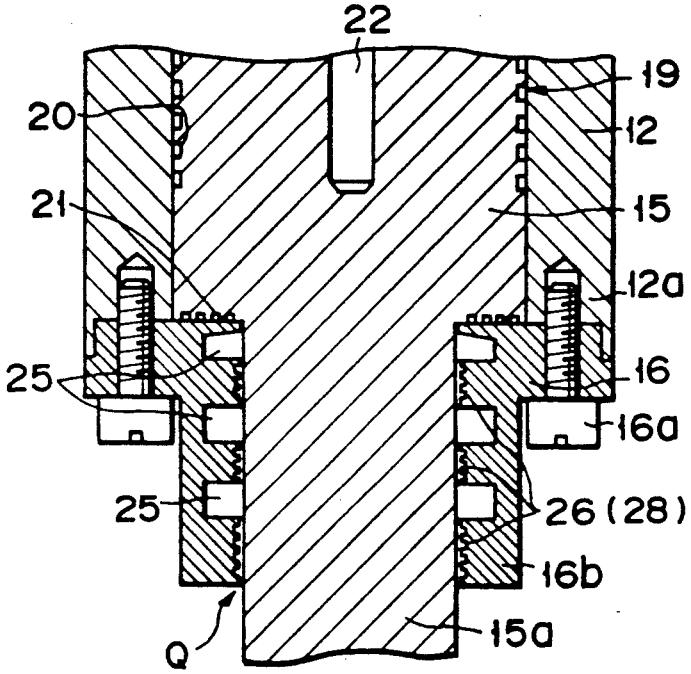
FIG. 10 shows a longitudinal sectional view of the essential portion of the rotary-anode type X-ray tube according to a get another embodiment of the present invention.

In the embodiment shown in FIG. 10, three cylindrical hollow regions 25 are provided on the inner surface of the cylindrical member 16*b*, and in addition, a plurality of pumping-use spiral grooves 26 is provided on the inner surface of the cylindrical member 16*b* located in a narrow gap, in order to prevent lubricant from leaking outside. As in the embodiment shown in FIG. 9, even when bubbles are generated in the bearing unit, they can smoothly be replaced by liquid metal lubricant. In addition, even if the lubricant leaks out of the bearing unit, it can reliably be held in a plurality of hollow regions. Further, owing to the pumping function of these spiral grooves 26, the lubricant can more prevented from leaking into the space of the vaccum container 18.

Some of circumferential hollows can be formed in the small-diameter portion 15*a* of the fixed shaft 15, and the remaining hollows can be in the opening blocking body 16 of the rotary structure 12.

Figure 11:
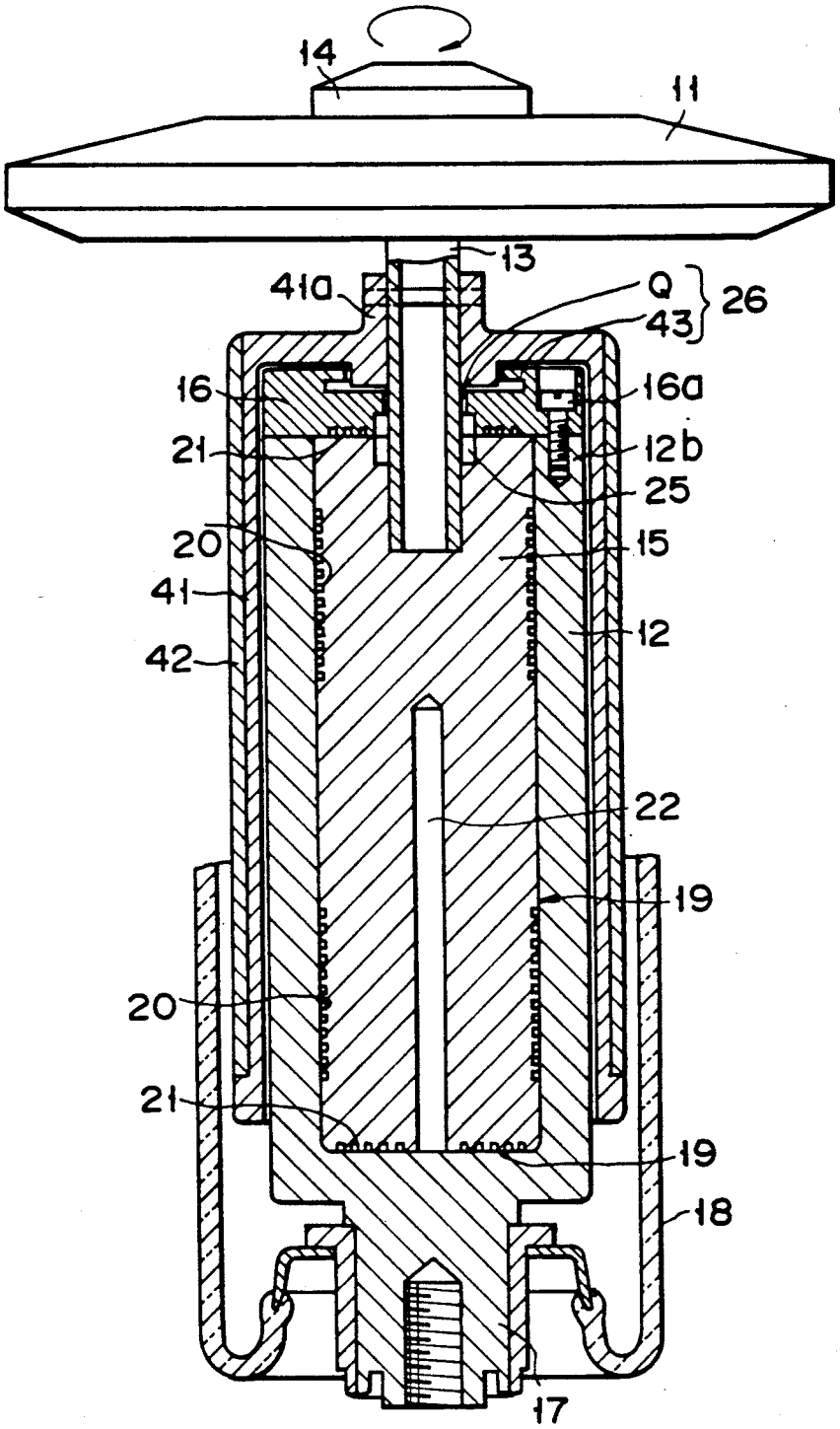
FIG. 11 shows a longitudinal sectional view of the rotary-anode type X-ray tube according to a still another embodiment of the present invention.
Figure 12:
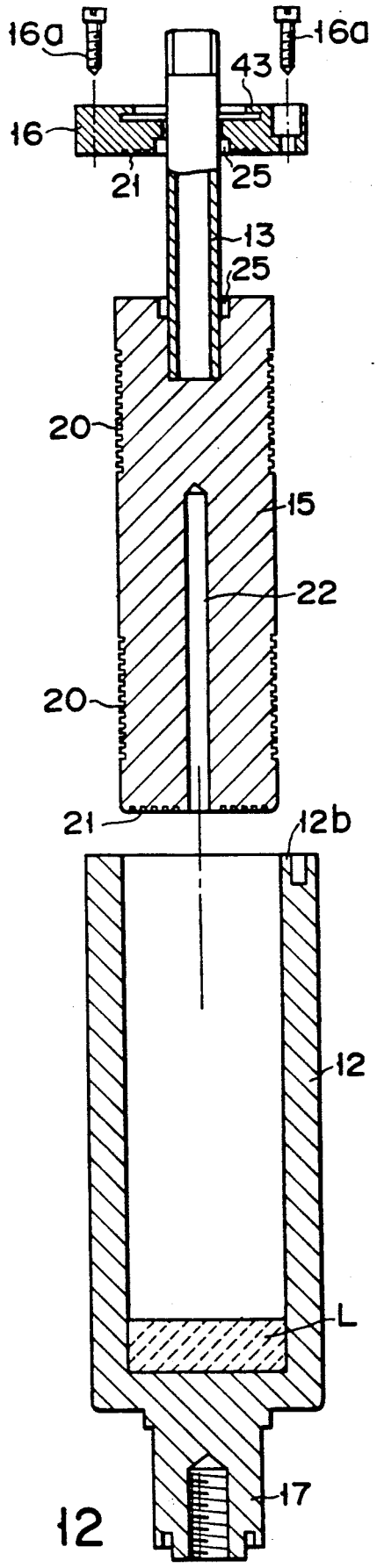
FIG. 12 shows a longitudinal sectional view of some components of the rotary-anode type X-ray tube shown in FIG. 11, while is being assembled.

In the embodiment shown in FIGS. 11 and 12, a cylindrical rotary shaft 13 is coupled to the anode target 11 and rotate together with the target 11. The cylindrical rotary shaft 13 is aligned with the axis of the X-ray tube 18. A rotary shaft 13 made of a pipe is secured to the top of the rotary shaft 15, and the anode target 11 is secured to the rotary shaft 13. A stationary structure 12, which is a hollow cylinder closed at one end is installed, surrounding the rotary shaft 13. An ring block 16 is secured to the top opening section 12*b* of the stationary structure 12 by screws. A ferromagnetic cylinder 41, functioning as a motor rotor, and a copper cylinder 42 surrounding the cylinder 41 are coaxially arranged around the stationary structure 12. The top 41*a* of the cylinder 41 is mechanically secured to the rotary shaft 13. The ring block 16 contacts the top surface of the rotary shaft 13. A spiral groove 21 is formed on the contact surface. An annular space 25 is formed in the lower portion of the inner surface of the ring block 16. This space 25 is located around the axis of the rotary shaft 13. The space 25 communicates with the interior of the bearing having the spiral groove 21. A lubricant-leak-preventive small gap Q and a radially folded portion 43 are provided in a passage connected to the interior of the X-ray tube. Small gap Q and radially folded portion 43 are formed of the hollow space 25 and the gap between the outer periphery of the stationary structure 12 and the inner periphery of the ferromagnetic cylinder 41. A film for securing attachment of lubricant can be formed on the inner surface of the folded portion 43.

To assemble the rotary anode structure, the stationary structure 12 with the opening 12*b* turned upward is set in a vacuum bell jar (not illustrated), as shown in FIG. 12. The rotary shaft 13 not holding the anode target, the ring block 16, and the screws 16*a* are positioned and hung from the top of the stationary structure 12. The bell jar is evacuated, and each bearing member is heated by heating means, thereby discharging the stored gas. Then the liquid metal lubricant L is injected into the stationary structure 12. Next, the rotary shaft 13 with rotary structure 15 is lowered from the top and inserted into the stationary cylinder 12. The ring block 16 is secured by screws. The lubricant L flows into the gap between bearing surfaces and also into the lubricant storing chamber 22. If gas leaks from each portion, bubbles move upward, passing through the gap between the bearing surfaces, and reaches the annular space 25, and then it is exhausted to the outside. Then, the lubricant enters the gap between the bearing surfaces.

Metal lubricant, mainly made of Ga, Ga—In, or Ga—In—Sn, can be used. It is also possible to use Bi—In—Pb—Sn alloy containing, a relatively-large amount of bismuth (Bi), In—Bi alloy containing relatively-large amount of In, or In—Bi—Sn alloy. Because these alloys have a melting point equal to room temperature or a higher temperature, it is recommended that metal lubricant is heated to the room temperature or a higher temperature before the anode target is rotated.

According to the present invention, as mentioned above, the bubbles in the bearing are smoothly replaced by the liquid metal lubricant, by virtue of annular space, even if the bubbles are produced in the sliding bearing when the rotary-anode structure is assembled or the X-ray tube operates. This is because the annular space is close to the end where the sliding bearing surface reaches the interior of the vacuum envelope. A lubricant leak preventive structure with a small gap is formed in the passage extending from the annular space to the interior of the vacuum envelope. The lubricant is prevented from leaking directly into the vacuum envelope through the gap between the bearing surfaces. Therefore, the gap between the bearing surfaces is filled with the lubricant, and the bearing can be lubricanted. Thus, the X-ray tube can operate stably.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A rotary-anode type X-ray tube comprising:

an anode target;

a rotary structure to which said anode target is fixed;

a stationary structure, coaxially arranged with said rotary structure, for rotatably supporting said rotary structure;

a hydrodynamic bearing formed between said rotary structure and said stationary structure, said hydrodynamic bearing having a first gap in which a metal lubricant is applied, the metal lubricant being in liquid state during rotation of said rotary structure;

a vacuum envelope in which said rotary and stationary structures and said hydrodynamic bearing are installed; and separating means for separating metal lubricant and gas bubbles formed therein, said separating means including a first annular space formed between said rotary structure and stationary structure and communicating with the first gap, a second gap formed between said rotary structure and stationary structure, the second gap communicating the annular space with an inner space of the vacuum envelope, and the second gap being narrower than the annular space.

2. An X-ray tube according to claim 1, wherein said separating means includes a surface having no wetability characteristic with respect to the metal lubricant, and said surface of said separating means defines the second gap.

3. An X-ray tube according to claim 1, wherein said separating means includes a second annular space and a third gap formed between said rotary structure and stationary structure, the third gap being narrower than the second annular space, the second annular space communicating with the first annular space through the third gap and communicating with the first gap of said hydrodynamic bearing via said first annular space.

4. An X-ray tube according to claim 1, wherein said hydrodynamic bearing includes a thrust bearing and the first annular space being arranged near the thrust bearing.

5. A rotary-anode type X-ray tube according to claim 1, wherein the separating means has a surface facing the second gap in which a spiral groove is formed to return the liquid metal lubricant to the first annular space.

6. An X-ray tube according to claim 1, wherein said hydrodynamic bearing includes a thrust bearing having a bearing surface which defines the first annular space.

7. An X-ray tube according to claim 1, wherein said hydrodynamic bearing includes a bearing section for pulling the metal lubricant from the first annular space to said hydrodynamic bearing.

8. An X-ray tube according to claim 1, wherein said stationary structure has a columnar shape and is rotatably inserted in the rotary structure.

9. An X-ray tube according to claim 8, further comprising a lubricant storage chamber for receiving the lubricant, which is formed in said stationary structure and communicates with the first gap.

10. An X-ray tube according to claim 9, wherein said stationary structure has an outer surface, said rotary structure has an inner surface and said hydrodynamic bearing includes spiral grooves formed on at least one of the outer surface of said stationary structure and the inner surface of said rotary structure.

11. An X-ray tube according to claim 1, wherein said rotary structure has a columnar shape and is inserted in said stationary structure.

12. An X-ray tube according to claim 11, further comprising a lubricant storage chamber for receiving the lubricant, which is formed in said rotary structure and communicates with the first gap.

13. An X-ray tube according to claim 12, wherein said rotary structure has an outer surface, said stationary structure has an inner surface and said hydrodynamic bearing includes spiral grooves formed on at least one of the outer surface of said stationary structure and the inner surface of said rotary structure.

* * * * *